US009017545B2

(12) United States Patent
Zhang et al.

(10) Patent No.: US 9,017,545 B2
(45) Date of Patent: Apr. 28, 2015

(54) PROCESS FOR HYDROTREATING INFERIOR NAPHTHA FRACTION

(71) Applicants: China Petroleum & Chemical Corporation, Beijing (CN); Fushun Research Institute of Petroleum and Petrochemicals, Sinopec, Fushun, Liaoning Province (CN)

(72) Inventors: Ying Zhang, Fushun (CN); Baozhong Li, Fushun (CN); Ronghui Zeng, Fushun (CN); Youliang Shi, Fushun (CN)

(73) Assignees: China Petroleum & Chemical Corporation, Beijing (CN); Fushun Research Institute of Petroleum and Petrochemicals, Sinopec, Fushun, Liaoning (CN)

( * ) Notice: Subject to any disclaimer, the term of this patent is extended or adjusted under 35 U.S.C. 154(b) by 267 days.

(21) Appl. No.: 13/662,148

(22) Filed: Oct. 26, 2012

(65) Prior Publication Data

US 2013/0118953 A1 May 16, 2013

(30) Foreign Application Priority Data

Nov. 10, 2011 (CN) ..... 2011 1 0353679
Nov. 10, 2011 (CN) ..... 2011 1 0353703

(51) Int. Cl.
*C10G 67/02* (2006.01)
*C10G 45/06* (2006.01)
(Continued)

(52) U.S. Cl.
CPC ..... *C10G 67/02* (2013.01); *C10G 45/36* (2013.01); *C10G 45/38* (2013.01); *C10G 45/72* (2013.01);
(Continued)

(58) Field of Classification Search
CPC ..... C10G 31/09; C10G 45/06; C10G 45/08; C10G 45/36; C10G 45/38; C10G 45/72; C10G 67/02
USPC ..... 208/88, 92, 100, 143–144, 211, 212, 208/216 R, 217
See application file for complete search history.

(56) References Cited

U.S. PATENT DOCUMENTS 2,937,131 A * 5/1960 De Chellis ..... 208/48 R
4,113,603 A 9/1978 Bauer
(Continued)

FOREIGN PATENT DOCUMENTS

CN 1084547 A 3/1994
CN 1109495 A 3/1994
CN 101343566 A 1/2009

*Primary Examiner* — Renee E Robinson
(74) *Attorney, Agent, or Firm* — Novick, Kim & Lee, PLLC; Allen Xue

(57) ABSTRACT

Disclosed is a process for hydrotreating inferior naphtha fraction, comprising: (1) warming a recycle oil in a heating device; (2) mixing the inferior naphtha fraction with the recycle oil before and/or after the heating device; and (3) feeding the mixture of the inferior naphtha fraction and the recycle oil into a separating unit, wherein the gas-liquid separation is realized at least to obtain a gas phase and a liquid phase, wherein the gas phase comprises gasified inferior naphtha, wherein the gas phase enters a hydrotreating reactor to undergo hydrotreating, and wherein part of the liquid phase circulates to the heating device as the recycle oil; wherein warming of the recycle oil is controlled to ensure the temperature of gas phase from the separator at least reaches the inlet temperature of the hydrotreating reactor. Comparing with the prior art, the inventive process effectively solves the coking problem of the hydrogenating unit for inferior naphtha fraction.

19 Claims, 3 Drawing Sheets

(51) Int. Cl.

| | |
|---|---|
| ***C10G 45/36*** | (2006.01) |
| ***C10G 45/72*** | (2006.01) |
| ***C10G 31/09*** | (2006.01) |
| ***C10G 45/38*** | (2006.01) |
| ***C10G 29/20*** | (2006.01) |
| ***C10G 35/04*** | (2006.01) |
| ***C10G 45/08*** | (2006.01) |
| ***C10G 59/04*** | (2006.01) |

(52) U.S. Cl.

CPC ..... *C10G 31/09* (2013.01); *C10G 2300/104* (2013.01); *C10G 2300/1044* (2013.01); *C10G 2300/4081* (2013.01); *C10G 2400/02* (2013.01); *C10G 29/20* (2013.01); *C10G 35/04* (2013.01); *C10G 45/06* (2013.01); *C10G 45/08* (2013.01); *C10G 59/04* (2013.01)

(56) References Cited

U.S. PATENT DOCUMENTS

| | | | | |
|---|---|---|---|---|
| 4,422,927 | A * | 12/1983 | Kowalczyk et al. | 208/211 |
| 2007/0012596 | A1 * | 1/2007 | Picard et al. | 208/112 |
| 2007/0261994 | A1 * | 11/2007 | Araki et al. | 208/216 R |
| 2010/0243520 | A1 * | 9/2010 | Glover et al. | 208/59 |

* cited by examiner

PROCESS FOR HYDROTREATING INFERIOR NAPHTHA FRACTION

FIELD OF THE INVENTION

The present invention generally relates to a process for hydrotreating inferior naphtha fraction, more particularly, to a process for prolonging the operation period of a unit for one-stage hydrotreating inferior naphtha fraction.

BACKGROUND OF THE INVENTION

With the increasing demand for processing heavier crude and higher conversion of crude, processes for treating heavy and refractory feedstock play a more important role in refineries. Owing to its relatively simple technique and lower investment, delayed coker is becoming more and important for processing heavy oil and residual oil. Full-range distillates including naphtha as dominate liquid product is obtained from the delayed coker. Since coker naphtha, also called coker gasoline is unsuitable feedstock for downstream process due to its high content of unsaturated hydrocarbons and impurities such as sulfur, nitrogen and etc as well as poor stability, it cannot be directly used as feedstock for consequent procedures. It must be hydrofined to improve its stability and to remove the impurities such that it can be widely used, for example, as a feedstock for ethylene production, a feedstock for synthetic ammonia and a feedstock for reforming, and as chemical light oils and automotive fuels.

Fluid Catalytic cracking (FCC) is also an important means for deep processing heavy oils and residual oils. Different from delayed coking, FCC feedstock, generally hydroprotreated, has a better crackability. Similar to delayed coking, FCC products such as naphtha and LCO have a high level of unsaturated hydrocarbons and a certain amount of impurities such as sulfur, nitrogen, etc.

Some naphtha fraction from other industrial processes such as pyrolysis also has the similar properties as above.

The above-mentioned naphtha fraction with poor quality from coker, FCC and pyrolysis processes is stated as inferior naphtha (gasoline) fraction in the present patent.

Industrial practice shows that one of the major problems to affect operation, the hydrotreater for inferior naphtha has to be shutdown due to the short-term increase of pressure drop across the layers of the hydrogenation catalyst bed, which is mainly caused by the polymerization of the dienes in the feedstock. Under higher temperature, olefins, dienes and the like in the feedstock are prone to form macromolecular organic compounds via Diels-Alder recycle reaction or polymerize reaction, and even further condensed to coke. These coking reactions mainly occurred at such parts as high-temperature heat exchanger, heating furnace and the top of the reactor. Frequent shutdown caused by coking severely disturbs the normal unit operation.

In the prior art for hydrotreating inferior naphtha fraction, although outlet temperature materials from heat exchanger and heating furnace is not high, the higher wall temperature leads heat exchanger and heating furnace to severe coking. The coke in the heat exchanger and the heating furnace may sometimes enter the reactor with the feedstock and deposit on the top of reactor catalyst bed, which further accelerates the blocking of the catalyst bed.

U.S. Pat. No. 4,113,603 discloses a two-stage hydrofining process for treating dienes and sulfides in pyrolysis gasoline, wherein a Ni—W catalyst is used in the first stage to remove thiol, and a noble metal palladium catalyst is used in the second stage to remove dienes. This process is complex.

Since the noble catalyst is intolerant to sulfur and the reaction temperature is low, such process is not suitable for hydrogenating coke naphtha.

CN200710012091.0 discloses a method of improving the operation period of the device for hydrotreating inferior naphtha, wherein an additional reactor is set before the heating furnace so that the inferior naphtha is first subjected to a reaction at a low temperature for selectively hydrogenating dienes in the additional reactor, and then passed into a main reactor to undergo hydrogenation to remove the impurities such as sulfur and nitrogen as well as olefin saturation reaction. During this method, the feedstock of the first reactor needs to be warmed to the desired temperature in a heat exchanger. Although the required inlet temperature of the first reactor is low, the tube wall of the heat exchanger has a very high temperature (i.e. the temperature of the outlet materials of the second reactor, normally above 300). Accordingly, the heat exchanger is still subject to a coking problem.

SUMMARY OF THE INVENTION

To solve the problems in the prior art, the present invention provides a process and a system for hydrotreating inferior naphtha fraction. The inventive process and system can effectively alleviate or inhibit the coking problem in a hydrotreating device and thereby the operation period is extended.

In one aspect, the present invention provides a process for hydrotreating inferior naphtha fraction, comprising:

(1) warming a recycle oil in a heating device;

(2) mixing the inferior naphtha fraction with the recycle oil before and/or after the heating device; and (3) feeding the mixture of the inferior naphtha fraction and the recycle oil into a separating unit, wherein the gas-liquid separation is realized at least to obtain a gas phase and a liquid phase, wherein the gas phase comprises gasified inferior naphtha, wherein the gas phase enters a hydrotreating reactor to undergo hydrotreating, and wherein part of the liquid phase circulates to the heating device as the recycle oil;

wherein warming of the recycle oil is controlled to ensure the temperature of gas phase from the separator reaches the inlet temperature of the hydrotreating reactor.

In another aspect, the present invention provides a system for hydrotreating inferior naphtha fraction comprising a heating device, a separating unit and a hydrotreating reactor, wherein the outlet of the heating device is connected with the inlet of the separating unit through lines, the outlet of the separating unit is connected with the inlet of the hydrotreating reactor through lines.

The present invention has the following advantages comparing with the prior art.

(1) The high temperature heat exchanger for heating inferior naphtha fraction is removed. Instead, the inferior naphtha fraction is directly mixed with the heated recycle oil. Since such direct mixing avoids the local high temperature and mixing time is short, the coking problem occurred when adopting a high temperature heat exchanger is avoided. Accordingly, the deposition of coking substances in the heat exchanger or in the reactor is no more occurred. In addition, the heat utilization efficiency is improved.

(2) Application of heating device to warm recycle oil or the mixture of the inferior naphtha fraction and recycle oil facilitates to alleviate or even avoid the coking problem. In addition, the coke can be easily taken out from the heating device by recycle oil. Accordingly, the influence on heating device from coking is lowered.

(3) The recycle oil does not enter the hydrotreating reactor, so the hydrogenation reaction is not affected.

DESCRIPTION OF THE DRAWINGS

The above and other characters of the present invention can be more clear and detailed through perfect description of the following figures, in which.

BEST MODE FOR CARRYING OUT THE INVENTION

Figure 1:
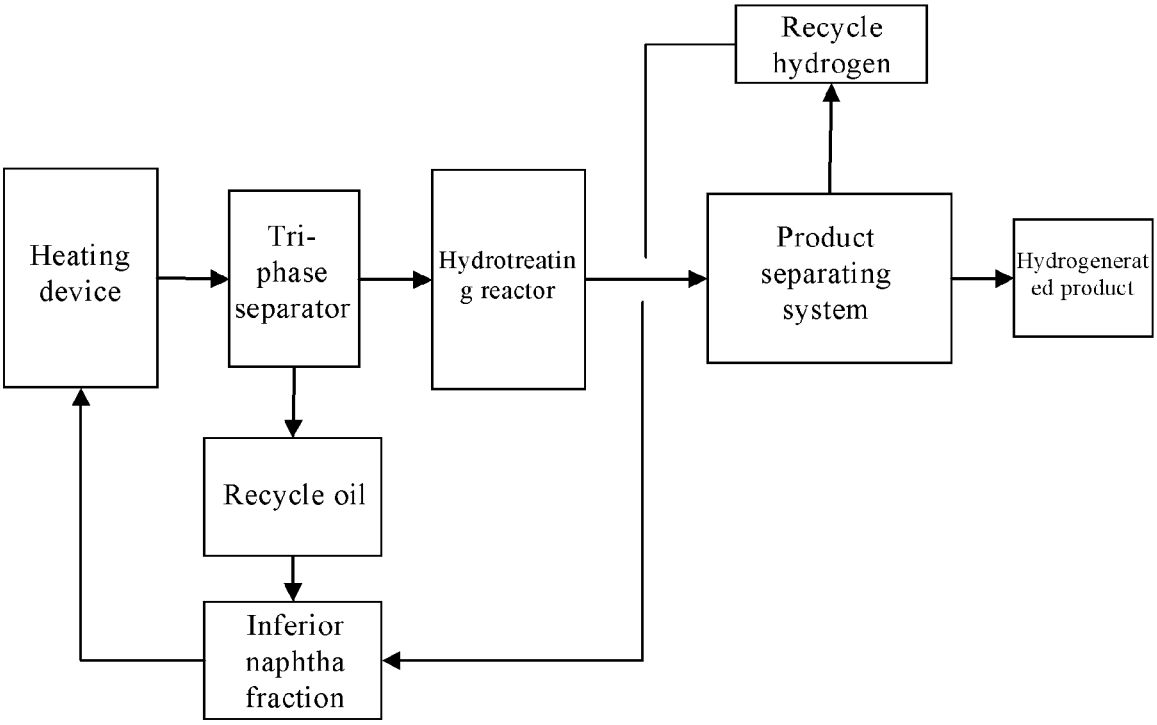
FIG. 1 is a flowchart of one process according to the present invention.

In one aspect, the present invention provides a process for hydrotreating inferior naphtha fraction, comprising:

(1) warming a recycle oil in a heating device;

(2) mixing the inferior naphtha fraction with the recycle oil before and/or after the heating device; and (3) feeding the mixture of the inferior naphtha fraction and the recycle oil into a separating unit, wherein the gas-liquid separation is realized at least to obtain a gas phase and a liquid phase, wherein the gas phase comprises gasified inferior naphtha, wherein the gas phase enters a hydrotreating reactor to undergo hydrotreating, and wherein part of the liquid phase circulates to the heating device as the recycle oil;

wherein warming of the recycle oil is controlled to ensure the temperature of gas phase from the separator reaches the inlet temperature of the hydrotreating reactor.

In the first embodiment, the inventive process comprises:

(1) mixing the inferior naphtha fraction with a recycle oil;

(2) warming the mixture of the inferior naphtha fraction with the recycle oil in a heating device; and (3) feeding the mixture into a separating unit, wherein the gas-liquid separation is realized at least to obtain a gas phase and a liquid phase, wherein the gas phase comprises gasified inferior naphtha, wherein the gas phase enters a hydrotreating reactor to undergo hydrotreating, and wherein part of the liquid phase circulates to the heating device as the recycle oil;

wherein warming of the recycle oil is controlled to ensure the temperature of gas phase from the separator reaches the inlet temperature of the hydrotreating reactor.

In the second embodiment, the inventive process comprises:

(1) warming a recycle oil in a heating device;

(2) mixing the inferior naphtha fraction with the warmed recycle oil to form a mixture; and (3) feeding the mixture into a separating unit, wherein the gas-liquid separation is realized at least to obtain a gas phase and a liquid phase, wherein the gas phase comprises gasified inferior naphtha, wherein the gas phase enters a hydrotreating reactor to undergo hydrotreating, and wherein part of the liquid phase circulates to the heating device as the recycle oil;

wherein warming of the recycle oil is controlled to ensure the temperature of gas phase from the separator reaches the inlet temperature of the hydrotreating reactor.

In the first application, the inventive process further comprises a step of:

before feeding into the separating unit, filtering the mixture by a solid filter to remove solids therein; and/or after the gas-liquid separation, filtering the liquid phase by a solid filter to remove solids therein.

The solid filter may those commonly used in the art. In general, used is a filter that may cut off a solid impurity with a diameter of larger than about 2 mm, preferably about 0.5 mm. Removing solids by the solid filter ensures a long period of stable operation of the separation unit. In addition, it also brings advantages to the long period of stable operation of the hydrotreating reactor.

In another variant, the separation unit is a tri-phase separator, wherein the resulting gas phase is discharged from the top of the tri-phase separator and enters into the hydrotreating reactor, the solid impurities remain in the tri-phase separator, and the resulting liquid phase is discharged from the bottom of the tri-phase separator and circulated as the recycle oil toward the heating device.

One tri-phase separator may be used. Alternatively, two may be used in switch operating.

The tri-phase separator may be consisting of an outer body and an inner solid filter cylinder, wherein the outer body has a feedstock inlet disposed at the middle and a gaseous material discharging outlet disposed at the top, wherein the inner solid filter cylinder is fixed in the middle of the outer body, and wherein the tri-phase separator has a liquid outlet at the bottom, which liquid outlet is connected with the inside of the inner solid filter cylinder such that liquid material is passed through the inner solid filter cylinder and then discharged from the liquid outlet. A liquid level controlling device, such as liquid level gauge, may be incorporated into the tri-phase separator.

In particular, the tri-phase separator may be consisting of an outer body and an inner solid filter cylinder, wherein the inner and outer layers of the body of the inner solid filter cylinder are sieves. A filtering agent may be filled between the sieves of the inner and outer layers. The filtering agent filed between said sieves may have a particle diameter of about 1 to about 3 mm and a thickness of about 10 to about 200 mm. It may be a material selected from the group consisting of alumina, silica, ceramics, a hydrogenation catalyst, a waste hydrogenation catalyst and a mixture thereof. Preferably, a hydrogenation catalyst or a waste hydrogenation catalyst is used. The hydrogenation catalyst generally uses alumina as the carrier and one or more selected from the group consisting of W, Mo, Ni and Co as the active components. When in use, the active component is generally in sulfide form. The amount of the active components comprises about 15 wt % to about 50 wt % of the hydrogenation catalyst, calculated on the weight of the oxides of the active components. The waste hydrogenation catalyst normally refers to those obtained from the regeneration of a used hydrogenation catalyst. The waste hydrogenation catalyst has a reduced hydrogenating activity as compared with corresponding hydrogenation catalyst. The use of hydrogenation catalyst can achieve somewhat hydrogenation during the separation, which advantageously prevents the formation of solid impurities and thereby prolongs the operation life of the tri-phase separator.

In a further variant, the inventive process further comprises a step of feeding the reactor effluent of the hydrotreating reactor into a product separation system, in which the reactor effluent is cooled to perform the gas-liquid separation, wherein the obtained gas phase is mainly hydrogen which is recycled as recycle hydrogen to the hydrotreating reactor, and the obtained liquid phase is mainly hydrogenated products, such as the hydrogenated naphtha fraction.

In the above embodiments and variants, the recycle oil may be a hydrocarbon that is liquid at the operation temperature of the separating unit. Preferably, the recycle oil may be a hydrogenated petroleum fraction having an initial boiling point of from about 350 to about 550° C. More preferably, the recycle oil may be selected from the group consisting of hydrofined reduced pressure distillates, hydrofined lubricant base oils, hydrogenated residual oils and hydrogenated cracking tail oils.

In the above embodiments and variants, the inferior naphtha fraction may be those obtained from various secondary processing procedures, such as an inferior naphtha fraction obtained from a coking process, an inferior naphtha fraction obtained from a catalytic cracking process, an inferior naphtha fraction obtained from a pyrolysis process, an inferior naphtha fraction as a side product obtained from a ethylene production process, etc. Preferably, the inferior naphtha fraction may be one or more selected from the group consisting of coker gasoline, catalytically cracked naphtha and pyrolysis gasoline. Under the operating conditions of the separating unit, the inferior naphtha fraction is in gaseous state. The gaseous inferior naphtha fraction enters into the hydrtreating reactor to react with a hydrogen-containing gas. The hydrogen-containing gas used in the hydrtreating reactor includes the recycle hydrogen and optionally supplementary hydrogen. The hydrogen-containing gas is combined with the recycle oil and passed to the heating device. The supplementary hydrogen required by the hydrotreating reactor may be supplied at any step. For example, it may be supplied into the hydrotreating reactor, or into the recycle hydrogen.

In the above embodiments and variants, the inlet temperature of the hydrotreating reactor ranges from about 190 to about 320° C., preferably about 210 to about 280° C. The hydrogen and the feedstock have a volume ratio of from about 100:1 to about 1000:1 under the standard state. The hydrogenating reaction has a liquid hourly volume space velocity of from about 0.4 to about 10 $h^{-1}$, preferably about 1 to about 8 $h^{-1}$. The reaction pressure is from about 0.5 to about 15 MPa, preferably about 1 to about 10 MPa.

In the above embodiments and variants, the catalyst used in the hydrotreating reactor uses alumina as the carrier and one or more selected from the group consisting of W, Mo, Ni and Co as the active component. When in use, the active component is generally in sulfide form. The amount of the active components of the catalyst used in the hydrotreating reactor ranges from about 15 wt % to about 50 wt %, calculated on the weight of the oxides of the active components.

In the first embodiment, in the step of mixing the inferior naphtha fraction with the recycle oil, the amount of the recycle oil is about 5 wt % to about 200 wt %, preferably about 5 wt % to about 100 wt %, more preferably about 10 wt % to about 100 wt %, and most preferably about 10 wt % to about 60 wt % of the inferior naphtha fraction.

In the second embodiment, the warming temperature of the recycle oil in the heating device ranges typically from about 350 to about 550° C., preferably about 370 to about 490° C. Preferably, the inferior naphtha fraction is warmed to a temperature ranging from about 100 to about 180° C. in a heat exchanger before mixing with the recycle oil. In the step of mixing the inferior naphtha fraction with the warmed recycle oil, the amount of the warmed recycle oil is typically about 20 wt % to about 200 wt %, preferably about 50 wt % to about 120 wt % of the inferior naphtha fraction.

In anther aspects, the present invention provides a system for hydrotreating inferior naphtha fraction comprising a heating device, a separating unit and a hydrotreating reactor, wherein the outlet of the heating device is connected with the inlet of the separating unit through lines, the outlet of the separating unit is connected with the inlet of the hydrotreating reactor through lines.

In a variant, the inventive system for hydrotreating inferior naphtha fraction further comprises: a product separating system and a recycle hydrogen system, wherein the outlet of the hydrotreating reactor is connected with the product separating system through lines, the gas phase outlet of the product separating system is connected with the inlet of the recycle hydrogen system, and the outlet of the recycle hydrogen system is combined with the liquid phase outlet of the separating unit and connected with the inlet of the heating device through lines.

In another variant, the inventive system for hydrotreating inferior naphtha fraction further comprises a solid filter before and/or after the separating unit. The solid filter may those commonly used in the art. In general, used is a filter that may cut off a solid impurity with a diameter of larger than about 2 mm, preferably about 0.5 mm.

In a further variant, the separation unit is a tri-phase separator, wherein the gas phase discharged from the top of the tri-phase separator enters into the hydrotreating reactor, the solid impurities remain in the tri-phase separator, and the liquid phase is discharged from the bottom of the tri-phase separator and circulated as the recycle oil toward the heating device.

In the above embodiments and variants, the inventive system for hydrotreating inferior naphtha fraction further comprises feedstock lines, wherein the outlets of the feedstock lines are connected with the inlet of the heating device through lines, or the outlets of the feedstock lines are connected with the inlet of the separating unit through lines.

In the above embodiments and variants, the inventive system for hydrotreating inferior naphtha fraction further comprises supplementary hydrogen lines, wherein the outlets of the supplementary hydrogen lines are connected with the outlet of the recycle hydrogen system.

EXAMPLES

The present invention will be further illustrated below with reference to the examples. It should be understood that the examples described here are for illustration only and can not be construed for limiting the present invention.

In the examples, a small thermostatic fixed bed lab reactor was adopted. The heating device was an electronic heater. The cycling oil was a vacuum distillate.

Example 1

The procedure illustrated in FIG. 1 was adopted. The processing conditions, the results etc. of the example were summed in the below tables.

TABLE 1

Feedstock Properties

| Feedstock | coker naphtha fraction |
|---|---|
| Density (20° C.)/g · $cm^{-3}$ | 0.7215 |
| Distillation range/° C. | 40~210 |
| Sulphur content/wt % | 0.82 |
| Nitrogen content/wt % | 0.026 |
| Diolefin/g-$I_2$ · (100 g)$^{-1}$ | 5.7 |
| Bromine yalue/g-Br · (100 g)$^{-1}$ | 79.2 |
| Aromatic hydrocarbon/v % | 9.4 |

TABLE 2

| Properties of recycle oil | |
|---|---|
| Recycle oil | Hydrofined vacuum distillate |
| Distillation range/° C. | 395~550 |
| Sulphur content/μg · $g^{-1}$ | <1 |
| Nitrogen content/μg · $g^{-1}$ | <1 |

TABLE 3

| Composition and properties of Catalyst | |
|---|---|
| Catalyst | hydrofining catalyst |
| Composition of Catalyst | |
| $MoO_3$ + NiO/wt % | 21% + 6% |
| Carrier | Alumina |
| Major properties of Catalyst | |
| Specific surface area*/$m^2$ · $g^{-1}$ | 225 |
| Pore volume**/ml · $g^{-1}$ | 0.45 |

*The specific surface area of the Catalyst was measured according to the ASTM D3663-2003 method;
**the pore volume thereof was measured according to the ASTM D4222-2003 method.

TABLE 4

| Processing conditions of Example 1 | |
|---|---|
| Process conditions | |
| Weight ratio of cycling oil/feedstocks/% | 15 |
| Pressure/MPa | 4.5 |
| Volume ratio of hydrogen/oil | 800:1 |
| hydrofining reactor Volume space velocity, $h^{-1}$ | 1.2 |
| Temperature/° C. | |
| Inlet temperature of hydrofining reactor | 230 |
| Average temperature of hydrofining reactor | 320 |

TABLE 5

| Experimental results of Example 1 | |
|---|---|
| Results | |
| Nitrogen content at 300 hours/μg · $g^{-1}$ | <1.0 |
| Nitrogen content at 3000 hours/μg · $g^{-1}$ | 1.3 |
| Pressure drop at 3000 hours/Mpa | 0.05 |

It can be seen from the data of example 1 that the present process showed a high hydrotreating level even after 3000 hours. In particular, the problem of the pressure drop in the reactor was well solved without obvious coking in the heating device.

Example 2

Figure 2:
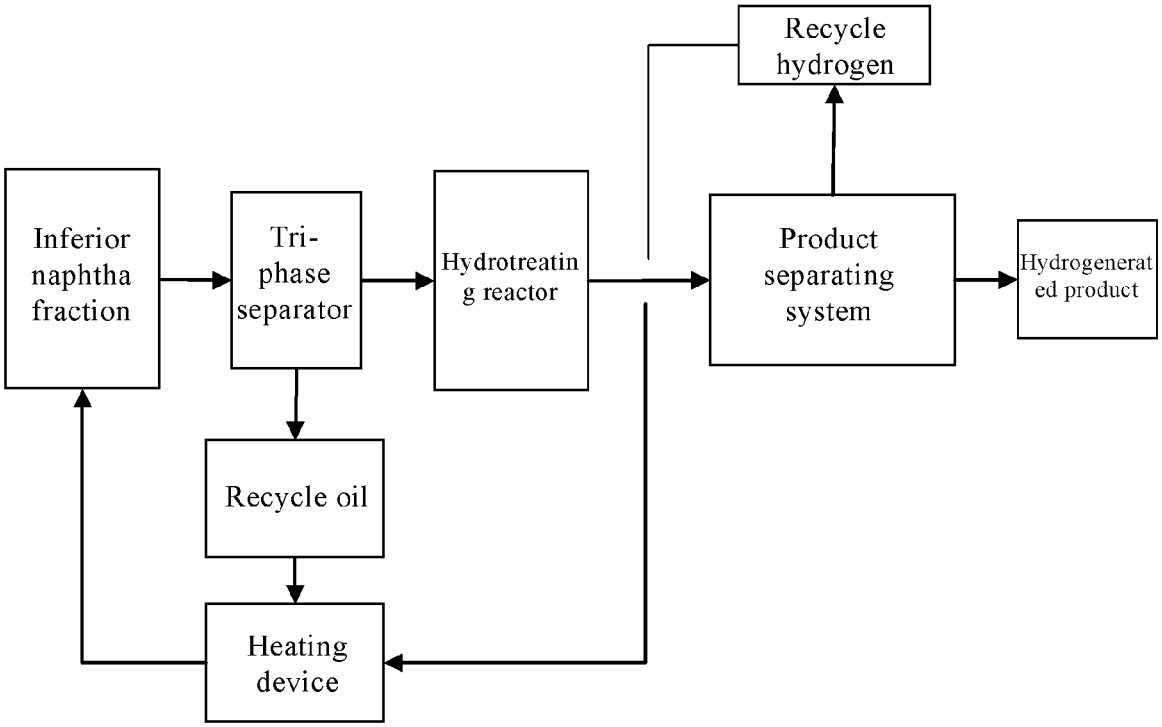
FIG. 2 is a flowchart of another process according to the present invention.

The procedure illustrated in FIG. 2 was adopted in example 2. The same feedstock, recycle oil and catalyst were used as Example 1 except that processing conditions as listed in the following table 6 was different. The results of the example 2 are summarized in the following table 7.

TABLE 6

| Processing conditions of Example 2 | |
|---|---|
| Process conditions | Data |
| Weight ratio of recycle oil/feedstock/% | 75 |
| The temperature of recycle oil-recycle hydrogen after heating/° C. | 490 |
| Pressure/MPa | 4.5 |
| Volume ratio of hydrogen/oil | 800:1 |
| hydrofining reactor Volume space velocity, $h^{-1}$ | 1.2 |
| Temperature/° C. | |
| Feedstock temperature after heat exchange | 160 |
| Inlet temperature of hydrofining reactor | 230 |
| Average temperature of hydrofining reactor | 300 |

TABLE 7

| Experimental results of Example 2 | |
|---|---|
| Results | Example |
| Nitrogen content at 300 hours/μg · $g^{-1}$ | <1.0 |
| Nitrogen content at 3000 hours/μg · $g^{-1}$ | 1.8 |
| Pressure drop at 3000 hours/Mpa | 0.05 |

It can be seen from the data of example 1 that the present process showed a high hydrotreating level even after 3000 hours. In particular, the problem of the pressure drop in the reactor was well solved without obvious coking in the heating device. A thermostatic reactor was adopted as the experimental device without considering the heat release during the reaction.

Example 3

Figure 3:
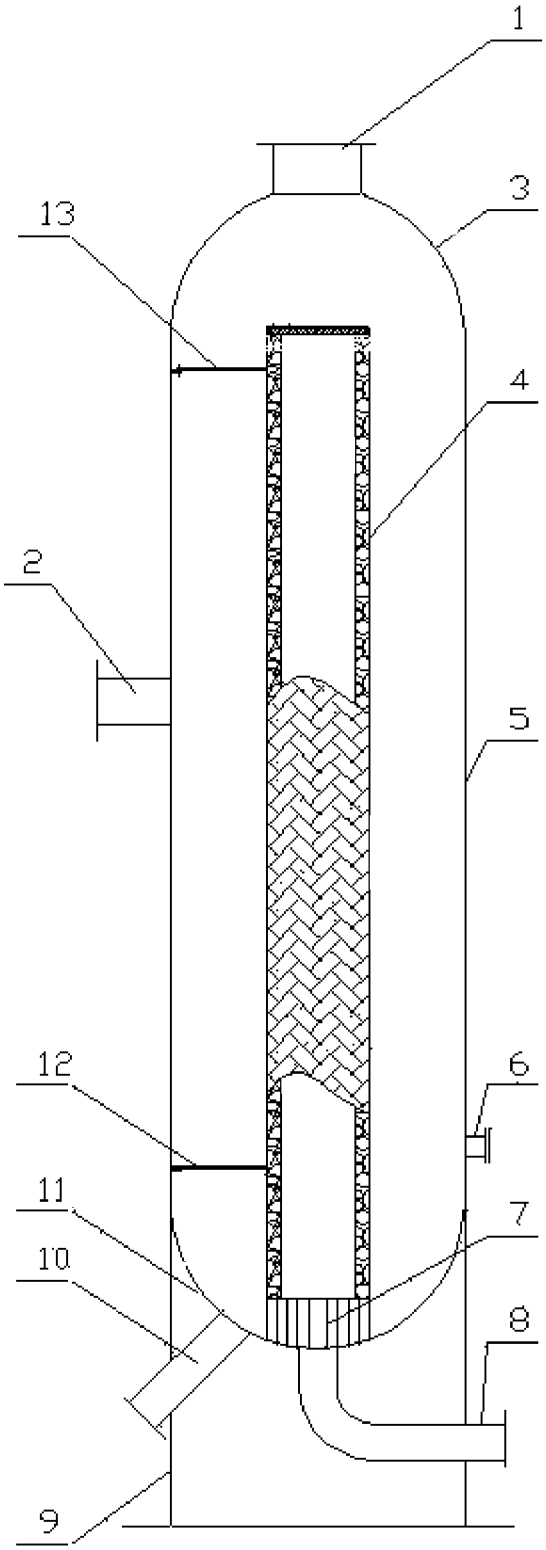
FIG. 3 is a schematic view of the structure of a tri-phase separator used in the process according to the present invention.

The structure of the tri-phase separator used in the separating unit was illustrated in FIG. 3. The tri-phase separator was consisting of an outer body and an inner solid filter cylinder, wherein the inner and outer layers of the body of the inner solid filter cylinder were sieves, and wherein a filtering agent was filled between the inner and outer layers.

Scheme A: the filtering agent filled between the sieves was a ceramic ball having a particle diameter of 2 mm. The thickness of the filtering agent was 100 mm. Scheme B: the filtering agent was a hydrogenation catalyst having a particle diameter of 2 mm. The hydrogenation catalyst had the same composition with that in Table 3. The thickness of the filtering agent was 100 mm.

Under the same processing conditions as Example 2, the tri-phase separator with Scheme A and Scheme B steadily operated for 7 months and 11 months, respectively. It demonstrated that the application of hydrogenation catalyst as the filtering agent in the tri-phase separator significantly prolonged the operation period of the tri-phase separator.

LIST OF REFERENCE SIGN

1—gaseous material outlet,
2—feedstock inlet,
3—top head,
4—solid filter,
5—outer body,
6—ash blowing outlet,
7—outlet collector,
8—liquid material outlet,
9—skirt,
10—ash discharging outlet,

11—bottom head,
12—bottom bracing component,
13—top bracing component

The invention claimed is:

1. A process for hydrotreating an inferior naphtha fraction, comprising:

heating a recycle oil in a heating device;

mixing the inferior naphtha fraction with the recycle oil before and/or after the heating device;

separating the mixture of the inferior naphtha fraction and the recycle oil in a separator to produce a gas phase and a liquid phase;

feeding the gas phase into a hydrotreating reactor to undergo hydrotreating; and feeding part at least a portion of the liquid phase circulates to the heating device as the recycle oil;

wherein the heating of the recycle oil is controlled so that a temperature of the gas phase from the separator reaches an inlet temperature of the hydrotreating reactor, wherein the separator comprises a filter having a filter wall arranged to form an inner chamber, wherein the inner chamber is connected to a first outlet of the separator, wherein a liquid portion of the mixture of the inferior naphtha fraction and the recycle oil passes through the filter wall, enters the inner chamber, and exits the separator through the first outlet as the liquid phase.

2. The process of claim 1, further comprising a step of:

filtering the mixture of the inferior naphtha fraction and the recycle oil to remove solids therein prior to the separator; and/or filtering the liquid phase to remove solids therein after the separator.

3. The process of claim 1, wherein the filter has a shape of a hollow cylinder.

4. The process of claim 1, wherein hydrogen used in the hydrotreating reactor is preheated in the heating device.

5. The process of claim 1, wherein the recycle oil is a hydrocarbon that is a liquid form at an operation temperature of the separating unit.

6. The process of any of the preceding claims, wherein the recycle oil is a hydrogenated petroleum fraction having an initial boiling point of from 350° C. to 550° C.

7. The process of claim 1, wherein the recycle oil is selected from the group consisting of hydrofined reduced pressure distillates, hydrofined lubricant base oils, hydrogenated residual oils, and hydrogenated cracking tail oils.

8. The process of claim 1, wherein the inferior naphtha fraction is heated to a temperature ranging from about 100° C. to about 180° C. in a heat exchanger before mixing with the recycle oil.

9. The process of claim 1, wherein the inlet temperature of the hydrotreating reactor ranges from 190° C. to 320° C., wherein a volume ratio of hydrogen and the feedstock is from 100:1 to 1000:1 under the standard state, wherein a liquid hourly volume space velocity is from 0.4 $h^{-1}$ to 10 $h^{-1}$, and wherein the reaction pressure is from 0.5 MPa to 15 MPa.

10. The process of claim 1, wherein the amount of the recycle oil is 5 wt % to 200 wt % of the inferior naphtha fraction.

11. The process of claim 1, wherein a catalyst used in the hydrotreating reactor comprises an alumina carrier and one or more selected from the group consisting of W, Mo, Ni, and Co as an active component and when in use, the active component is in sulfide form.

12. The process of claim 11, wherein an amount of the active components of the catalyst used in the hydrotreating reactor ranges from about 15 wt % to about 50 wt %, calculated on the weight of the oxides of the active components.

13. The process of claim 1, wherein the separator has a shell with a feedstock inlet installed thereon, wherein the filter resides inside the shell and is spaced away from the shell so that the mixture of the inferior naphtha fraction and the recycle oil enters the separator through the feedstock inlet into a space between the shell and the filter wall.

14. The process of claim 1, wherein the filter wall comprises an outer layer of screen, an inner layer of screen, and a filtering agent filled between the inner and outer layers of screens.

15. The process of claim 14, wherein the filtering agent filled between said screens is a hydrogenation catalyst or a waste hydrogenation catalyst.

16. The process of claim 14, wherein the filtering agent is selected from the group consisting of alumina, silica, ceramics, a hydrogenation catalyst, a waste hydrogenation catalyst, and a mixture thereof.

17. The process of claim 14, wherein the filtering agent has a particle diameter of 1.1 mm to 3 mm.

18. The process of claim 14, wherein the filtering wall is 10 mm to 200 mm in thickness.

19. The process of claim 1, wherein the amount of the recycle oil is 10 wt % to 100 wt % of the inferior naphtha fraction.

* * * * *